US005099624A

United States Patent [19]

Valentin

[11] Patent Number: 5,099,624

[45] Date of Patent: Mar. 31, 1992

[54] WINDOW SYSTEMS

[75] Inventor: Volker S. Valentin, Indiana, Pa.

[73] Assignee: L.B. Plastics Limited, Belper, England

[21] Appl. No.: 539,843

[22] Filed: Jun. 18, 1990

[51] Int. Cl.[5] ..... E05D 7/00; E06B 3/00; E06B 3/22

[52] U.S. Cl. ..... 52/207; 52/656; 52/775; 52/475

[58] Field of Search ..... 52/656, 207, 475, 775, 52/773, 774, 776; 49/400, 401, 402

[56] References Cited

U.S. PATENT DOCUMENTS 2,841,835 7/1958 Nardulli ..... 52/656
4,974,364 12/1990 Durham, Jr. ..... 52/656
4,979,346 12/1990 Pollard ..... 52/775

*Primary Examiner*—David A. Scherbel
*Assistant Examiner*—Joanne C. Downs
*Attorney, Agent, or Firm*—W. Thad Adams, III

[57] ABSTRACT

A set of components for use in constructing a sliding sash window comprises an outer frame member having parallel longitudinally extending channels or recesses therein adapted to accommodate balance spring mechanisms, cover members engageable with the outer frame in order to enclose or partially enclose the channels or recesses at appropriate regions of the assembled frame and to hide the balance spring mechanisms from view, and glazing members engageable with retaiing means formed on the cover members to enable a portion of the outer frame to be fixed glazed without removing the cover members.

12 Claims, 2 Drawing Sheets

WINDOW SYSTEMS

Figure 1:
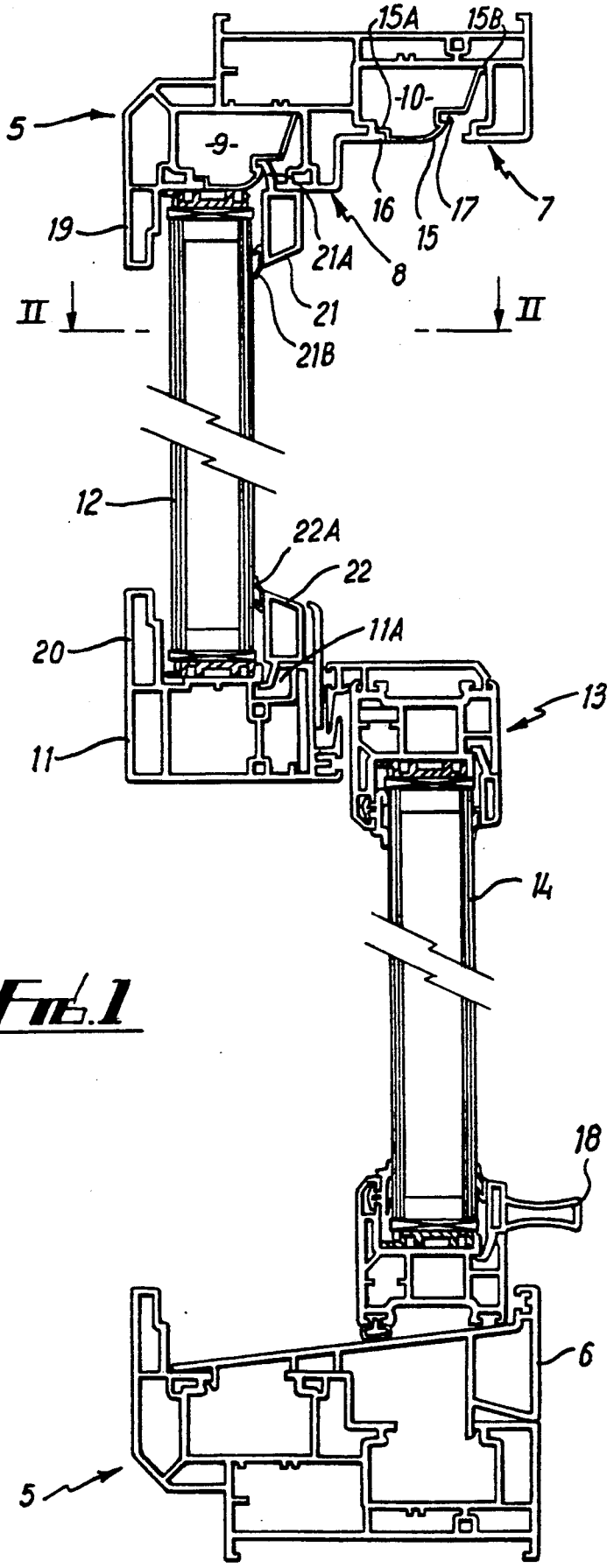

This invention relates to window systems and is especially applicable to window systems of the sliding sash type in which a movable inner or sash frame is mounted for sliding movement within a fixed outer frame. The invention is particularly applicable to "single hung" sash windows, that is windows in which the outer frame contains a fixed glazed region and a slidable sash frame movable relative thereto.

Single hung sash window constructions are generally arranged such that the movable sash frame is vertically slidable within the outer frame. The sash frame is connected to balance spring assemblies mounted at the sides of an enclosed within recesses formed in the outer frame sturcture. It is desirable that the same outer frame should be usable to construct both single and double hung sash windows (that is windows having two relatively movable sash frames and no fixed glazed region) but hitherto this has required the provision of additional components and has adversely affected the aesthetic appearance of the single hung version.

It is an object of the present invention to provide a window system in which the same components may be employed to produce single or double hung constructions while maintaining an acceptable visual appearance.

According to one aspect of the invention there is provided a component for use in the construction of a sliding sash window assembly, the component comprising a cover member, means on the cover member for engagement with a recess in an outer frame of a window assembly to at least partially cover the recess, and locating means on the cover member engageable by a glazing member to permit fixed glazing of the associated region of the frame without removing the cover member.

According to a further aspect of the invention there is provided a set of components for use in constructing a sliding sash window comprising an outer frame member provided with parallel longitudinally extending recesses therein adapted to accommodate balance spring mechanisms, a cover member engageable with said frame member in order to enclose or partially enclose said recesses at appropriate regions of the assembled frame, and a glazing member engagable with retaining means formed on said cover member to enable a portion of said outer frame to be fixed glazed without removing the cover member.

The invention also provides a window construction comprising an outer frame member at least the top and sides of which are formed from extruded plastics components having first and second spaced parallel inwardly opening recesses therein adapted to accommodate balance mechanisms for use in assoication with sliding sash frames, a sliding sash frame mounted in said outer frame for vertical sliding movement relative thereto in the plane of said first recesses and mounted on balance springs located within the first recesses in the side frame members, connecting means connecting upper regions of said balance spring assemblies with upper regions of the associated sash frame and movable along said recesses during opening and closing movement of the sash frame, said second recesses and those portions of said first recesses along which the connecting members do not move being closed or partially closed by cover members attached to said outer frame, and a portion of the window in the plane of said second recesses being fixed glazed by means of a glazing unit located therein and secured in place by glazing members engaged with retaining members formed on the cover members attached to the associated recesses.

Preferably said outer frame member incorporates inner and outer seating zones which may be fixed glazed or which may accommodate a sliding sash frame, said first and second recesses opening into said inner and outer zones respectively.

Preferably the outer zone of said outer frame is divided into upper and lower regions by means of an intermediate frame member, the upper region of the frame being fixed glazed and the lower region closed by said sliding sash frame.

Said cover members preferably partially enclose the associated recesses and are each provided with a longitudinally extending groove engageable by a flange formed on the associated glazing member, the glazing member also being provided with a seating portion adapted to locate on a fixed portion of said outer frame and having a flexible sealing member engageable with the fixed glazing unit.

Figure 2:
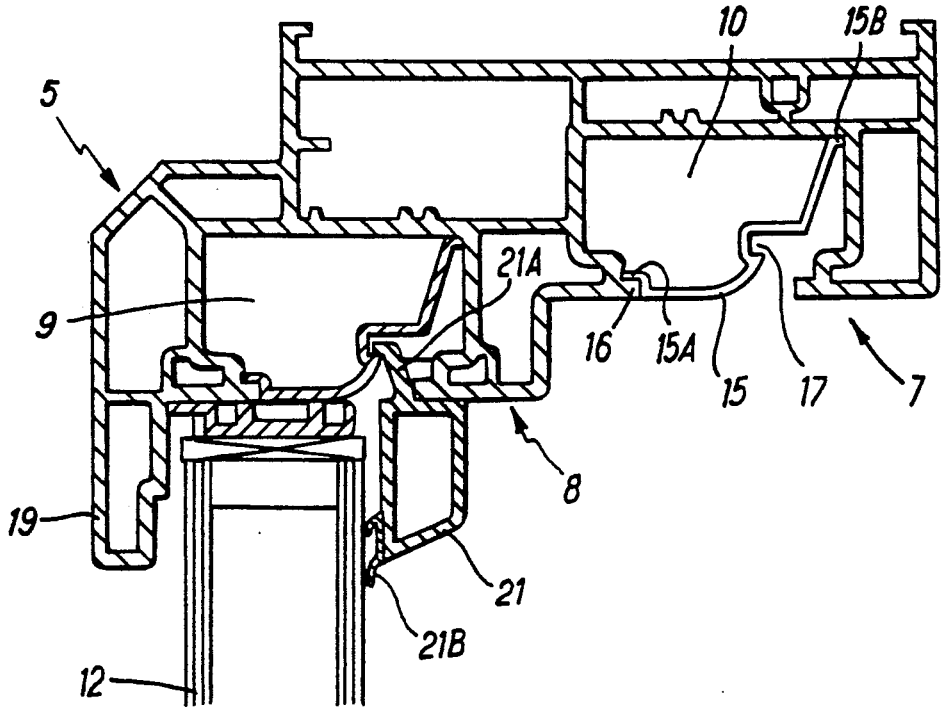

An embodiment of the invention will now be described, by way of example only, with reference to the accompanying diagrammatic drawings, in which:

FIG. 1 is a vertical cross-section through a single hung sliding sash window constructed in accordance with the invention; and FIG. 2 is a partial horizontal cross-section on the line II—II in FIG. 1 with parts omitted for clarity.

Referring to the drawings, the window comprises an outer frame the top and sides of which are constructed from an extruded plastics frame member 5 and the bottom of which is formed from a similar frame member 5 on which a sill member 6 is mounted. The frame members 5 are mitred at the corners of the frame and secured together by fusion welding, bolting or other suitable means. The frame members 5 incorporate inner and outer seating zones 7 and 8 each of which may be fixed glazed or may accommodate a sliding sash frame as will be hereinafter described. Longitudianlly extending recesses or channels 9,10 open into each of the zones 7,8 and are shaped and dimensioned to accommodate spring balance mechanisms (not shown) used when sliding sash frames are mounted in the main frame.

The outer zone of the main frame is divided into upper and lower regions by means of a horizontal transom or mullion member 11 connected at its opposite ends to the upright side frame members 5. The upper region of the zone 7 between the frame member 5 and the transom/mullion member 11 is fixed glazed by means of a double glazing unit 12, the lower region of the zone 7 being unglazed. A sliding sash frame 13 incorporating a glazing unit 14 is mounted in the inner zone 8 of the frame for vertical sliding movement between a lower closed position show in FIG. 1 and an upper open position in which the frame 13 is located alongside the fixed glazed upper portion of the outer zone 7. The sash frame 13 is connected adjacent its upper end to the upper ends of spring balance units (not shown) mounted in the lower portions of the inner recesses 10 of the side frame members 5. As the sash frame is moved between its lower and upper positions, the balance units extend and are operative to maintain the frame in any partially adjusted position between fully closed and fully open positions. The connecting member between the balance springs and the sash frame therefore projects from and moves along the upper portions of the channels 10 as the window is opened and closed.

The upper horizontal section of the channel 10 and the lower regions of the channels 10 below the connections between the sash frame and the balance units are closed by means of cover members 15. Each cover member comprises an elongated extruded plastics component having a projecting lip 15A at one edge engageable under a projection 16 on the main frame and a lip 15B at the other edge engageable in an inner corner of the recess 10. In this way the cover member locates within and partially encloses the recess 10 in those regions where it is fitted, thereby improving the aesthetic appearance of the frame. A recess or channel 17 is formed in the cover member 15 intermediate the edges 15A and 15B for a purpose which will be described hereinafter. The movable sash frame 13 is provided towards its lower end with a handle 18 to facilitate sliding movement between its upper and lower positions.

The fixed glazing unit 12 is maintained in position between fixed abutment members 19 and 20 formed respectively on the frame members 5 and 11 at the outer edges thereof, and removable glazing beads 21 and 22. The glazing bead 22 is engaged in a recess 11A in the frame member 11 and is provided with a flexible seal 22A engageable with the inner surface of the glazing unit 12. Glazing beads 21 are attached at the top and sides of the unit 12 and may be fitted to the frame 5 without removing the associated cover members 15. For this purpose the glazing beads 21 are provided with projecting legs 21A adapted to engage in the recesses 17 in the associated cover members 15. The glazing beads are also adapted to seat one the frame 5 at the inner edge of the entrance to the channels 9 and have flexible sealing members 21B engageable with the inner surface of the glazing unit 12. In this way the glazing unit 12 is retained in position in the outer zone of the main frame by glazing members attached to the cover members 15 which do not therefore require to be moved.

It should be appreciated that the frame 5 is so constructed that it may be used to construct either a single hung or a double hung window as desired. Thus the outer frame may be fitted with a fixed glazed unit and a single sliding sash frame as in the illustrated embodiment. Alternatively it may be fitted to produce a single hung window with upper and lower sliding sash frames by replacing the glazed unit 12 by a further sash frame to produce a double hung window. In this connection the cover members 15 serve a dual purpose. Firstly they serve to close off the recesses in those regions of the outer frame not transversd by the connection between the sash frame and balance spring units and enclose the portions of the balance units which would otherwise be exposed when the sash frame is opened. Secondly they serve as a location means for securing a fixed glazed unit into the frame. By using the cover members for the first purpose the same glazing member of bead may be used at all four sides of the fixed glazed unit without requiring any other component to be substituted for the cover member. This reduces the number of components required to assemble different window constructions and avoids the use of different glazing beads at different regions.

Various modifications may be made without departing from the invention. In particular the size, shape and internal construction of the various frame components may be substantially altered. The shape of the cover members, the manner in which they are attached to the outer frame member and the nature of the locating means for engagement with the glazing beads may be altered and the invention may be applied to single glazed or multiple glazed in addition to double glazed windows.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A component for use in the construction of a sliding sash window assembly, the component comprising a cover member, means on the cover member for engagement with a recess in an outer frame of a window assembly to at least partially cover the recess, and locating means on the cover member engageable by a glazing member to permit fixed glazing of the associated region of the frame without removing the cover member.

2. A component according to claim 1 wherein said locating means comprises a longitudinally extending groove engageable by a flange formed on the associated glazing member.

3. A set of components for use in constructing a sliding sash window comprising an outer frame member provided with parallel longitudinally extending recesses therein adapted to accommodate balance spring mechanisms, a cover member engageable with said frame member in order to enclose or partially enclose said recesses at appropriate regions of the assembled frame, and a glazing member engageable with retaining means formed on said cover member to enable a portion of said outer frame to be fixed glazed without removing the cover member.

4. A set of components according to claim 3 wherein said retaining means comprises a longitudinally extending groove engageable by a flange formed on said glazing member.

5. A set of components according to claim 4 wherein said glazing member includes a seating portion adapted to locate on a fixed portion of said outer frame.

6. A set of components according to claim 5 wherein said glazing member includes a flexible sealing member engageable with a glazing unit.

7. A window construction comprising an outer frame member at least the top and sides of which are formed from extruded plastics components having first and second spaced parallel inwardly opening recesses therein adapted to accommodate balance mechanisms for use in association with sliding sash frames, a sliding sash frame mounted in said outer frame for vertical sliding movement relative thereto in the plane of said first recesses and mounted on balance springs located within the first recesses in the side frame members, connecting means connecting upper regions of said balance spring assemblies with upper regions of the associated sash frame and movable along said recesses during opening and closing movement of the sash frame, said second recesses and those portions of said first recesses along which the connecting members do not move being closed or partially closed by cover members attached to said outer frame, and a portion of the window in the plane of said second recesses being fixed glazed by means of a glazing unit located therein and secured in placed by glazing members engaged with retaining members formed on the cover members attached to the associated recesses.

8. A window construction according to claim 7 wherein said outer frame member incorporates inner and outer seating zone which may be fixed glazed or which may accommodate a sliding sash frame, said first and second recesses opening into said inner said outer zones respectively.

9. A window construction according to claim 8 wherein the outer zone of said outer frame is divided into upper and lower regions by means of an intermediate frame member, the upper region of the frame being fixed glazed and the lower region closed by said sliding sash frame.

10. A window construction according to claim 7 wherein said retaining members comprise longitudinally extending grooves engaged by complementary flanges formed on said glazing members.

11. A window construction according to claim 10 wherein said glazing members include seating portions seated on adjacent fixed portions of said outer frame.

12. A window construction according to claim 11 wherein said glazing members include flexible sealing members engageable with said glazing unit.

* * * * *